US011064854B2

(12) United States Patent
Downing

(10) Patent No.: US 11,064,854 B2
(45) Date of Patent: Jul. 20, 2021

(54) CLEANER ATTACHMENT DEVICE

(71) Applicant: Darius Development Limited, Surrey (GB)

(72) Inventor: John Eugene Downing, Surrey (GB)

(73) Assignee: DARIUS DEVELOPMENT LIMITED, Surrey (GB)

( * ) Notice: Subject to any disclaimer, the term of this patent is extended or adjusted under 35 U.S.C. 154(b) by 304 days.

(21) Appl. No.: 16/305,826

(22) PCT Filed: May 31, 2017

(86) PCT No.: PCT/GB2017/051547

§ 371 (c)(1),
(2) Date: Nov. 29, 2018

(87) PCT Pub. No.: WO2017/207984

PCT Pub. Date: Dec. 7, 2017

(65) Prior Publication Data

US 2020/0022545 A1 Jan. 23, 2020

(30) Foreign Application Priority Data

May 31, 2016 (GB) ..... 1609510

(51) Int. Cl.
*A47L 9/06* (2006.01)
*A47L 9/24* (2006.01)

(52) U.S. Cl.
CPC ..... *A47L 9/0606* (2013.01); *A47L 9/248* (2013.01)

(58) Field of Classification Search
CPC ..... A47L 9/0606; A47L 9/248
See application file for complete search history.

(56) References Cited

U.S. PATENT DOCUMENTS

| | | | | |
|---|---|---|---|---|
| 1,053,665 A * | 2/1913 | Spencer | A47L 9/02 | 15/415.1 |
| 1,484,027 A | 2/1924 | Jacobs | | |
| 1,694,257 A | 12/1928 | Hagopian | | |
| 1,902,534 A * | 3/1933 | Wielatz | A47L 9/06 | 15/395 |
| 2,038,424 A | 4/1936 | Eli | | |
| 2,198,339 A * | 4/1940 | Hamilton | A47L 9/06 | 15/395 |
| 2,206,738 A * | 7/1940 | Brock | A47L 9/0693 | 15/395 |
| 2,232,358 A | 2/1941 | Baerer | | |

(Continued)

FOREIGN PATENT DOCUMENTS

| | | |
|---|---|---|
| BE | 516884 | 1/1953 |
| CA | 1179458 | 12/1984 |

(Continued)

*Primary Examiner* — Marc Carlson
(74) *Attorney, Agent, or Firm* — Jason P. Mueller; FisherBroyles, LLP

(57) ABSTRACT

Embodiments of this disclosure include a cleaner attachment device, and may include a device for attachment to a vacuum or pressure cleaner. Embodiments may include an attachment for cleaning behind water heaters or in other narrow spaces and may include an elongate body with a plurality of apertures arranged helically along the body, and a plurality of resiliently deformable portions arranged along the body and extending from the body.

21 Claims, 12 Drawing Sheets

(56) References Cited

U.S. PATENT DOCUMENTS

| | | | | |
|---|---|---|---|---|
| 2,243,120 | A * | 5/1941 | Pollitt | A47L 9/0613 15/395 |
| 2,584,515 | A | 2/1952 | Udell | |
| 2,606,338 | A * | 8/1952 | De Lorenzo | A47L 9/0693 15/395 |
| 2,608,710 | A | 9/1952 | Zaidan | |
| 2,611,917 | A | 9/1952 | Ventsias et al. | |
| 2,643,413 | A | 6/1953 | Buccasio | |
| 2,659,924 | A | 11/1953 | Forsberg | |
| 2,665,446 | A | 1/1954 | Gregory | |
| 2,679,068 | A | 5/1954 | Wied | |
| 2,963,611 | A | 11/1954 | Lombardi | |
| 2,811,738 | A | 11/1957 | Gall | |
| 2,821,736 | A | 2/1958 | Kasper | |
| 2,862,226 | A | 12/1958 | Peale | |
| 2,982,971 | A * | 5/1961 | Garaway | E04H 4/1681 210/167.16 |
| 3,015,336 | A | 1/1962 | Caples | |
| 3,176,772 | A * | 4/1965 | MacGregor | E21B 37/02 166/173 |
| 3,938,218 | A | 2/1976 | DeAmicis | |
| 4,053,962 | A | 10/1977 | McDowell | |
| 4,332,051 | A | 6/1982 | LaMonte | |
| D273,146 | S | 3/1984 | Farr | |
| 4,688,295 | A | 8/1987 | Starnes | |
| 4,694,529 | A | 9/1987 | Choiniere | |
| D293,141 | S | 12/1987 | Blocker | |
| 4,715,088 | A | 12/1987 | Haase | |
| D303,026 | S | 8/1989 | Kilakis | |
| D332,159 | S | 12/1992 | Arnold | |
| 5,319,821 | A * | 6/1994 | Nicholson | A46B 15/00 15/104.8 |
| D376,838 | S | 12/1996 | Potts et al. | |
| 5,802,667 | A * | 9/1998 | Williams | A46B 13/02 134/21 |
| 6,283,340 | B1 | 9/2001 | Waldner | |
| 6,370,731 | B1 * | 4/2002 | Carter | A47L 9/06 15/393 |
| 7,917,990 | B2 * | 4/2011 | Moroz | A47L 5/14 15/314 |
| 8,083,860 | B2 | 12/2011 | Loftis | |
| 8,205,296 | B1 | 6/2012 | Bissell et al. | |
| 9,820,559 | B2 * | 11/2017 | Axelsson | A61F 2/30721 |
| 2003/0014832 | A1 | 1/2003 | Huddleston | |
| 2003/0196293 | A1 | 10/2003 | Ruff | |
| 2007/0277345 | A1 | 10/2007 | Spann | |
| 2008/0250589 | A1 * | 10/2008 | Dingert | A46B 7/02 15/144.3 |
| 2008/0283093 | A1 * | 11/2008 | Loftis | B08B 1/00 134/6 |
| 2009/0133203 | A1 * | 5/2009 | Loftis | A47L 25/00 15/1 |
| 2010/0088845 | A1 * | 4/2010 | Kwon | A47L 9/248 15/415.1 |
| 2013/0255022 | A1 * | 10/2013 | Hammon | A47L 9/0693 15/246.2 |
| 2014/0366316 | A1 * | 12/2014 | Kim | A47L 9/0613 15/363 |
| 2018/0353028 | A1 * | 12/2018 | Goller | A47L 9/0606 |

FOREIGN PATENT DOCUMENTS

| | | |
|---|---|---|
| CA | 2686015 | 7/2010 |
| CA | 2749737 | 8/2010 |
| CN | 201216560 | 4/2009 |
| CN | 201469181 U | 5/2010 |
| CN | 202723764 | 2/2013 |
| CN | 202843545 U | 4/2013 |
| CN | 104013357 | 9/2014 |
| CN | 104013360 | 9/2014 |
| DE | 3831953 | 3/1990 |
| DE | 29611081 | 8/1996 |
| DE | 19728929 | 11/1997 |
| DE | 20313244 | 12/2003 |
| DE | 20313244 | 2/2004 |
| DE | 102004005832 | 9/2004 |
| DE | 102004000853 | 10/2009 |
| DE | 20101001030 | 7/2011 |
| EP | 0095532 | 12/1983 |
| EP | 0180367 | 5/1986 |
| EP | 1449473 | 8/2004 |
| ES | 1023962 | 8/1993 |
| FR | 2999067 | 6/2014 |
| GB | 308257 | 10/1929 |
| GB | 625072 | 6/1949 |
| GB | 0105781 | 5/2004 |
| GB | 0619231 | 4/2008 |
| GB | 201001387 | 8/2011 |
| JP | S56017044 U | 2/1981 |
| JP | S64040452 U | 3/1989 |
| JP | H09327423 | 12/1997 |
| JP | H10276835 | 10/1998 |
| JP | 20000116580 | 1/2001 |
| JP | 3105095 | 10/2001 |
| JP | 2002065526 | 3/2002 |
| JP | 2002177174 | 6/2002 |
| JP | 2003093288 | 4/2003 |
| JP | 2005211615 A | 8/2005 |
| JP | 2008136582 | 6/2008 |
| JP | 2010136799 | 6/2010 |
| JP | 2010166995 A | 8/2010 |
| JP | 2012115288 | 6/2012 |
| KR | 100507924 | 8/2004 |
| KR | 20070018714 | 2/2007 |
| KR | 20100006513 | 1/2010 |
| KR | 20130075684 | 7/2013 |
| WO | 2011078761 | 6/2011 |
| WO | 2014128445 | 8/2014 |

* cited by examiner

CLEANER ATTACHMENT DEVICE

CROSS-REFERENCE TO RELATED APPLICATIONS

This application is a national stage entry under 35 U.S.C. 371 of PCT Patent Application No. PCT/GB2017/051547, filed May 31, 2017, which claims priority to GB Patent Application No. 1609510.1, filed May 31, 2016, the entire contents of each of which are incorporated herein by reference.

FIELD OF THE INVENTION

The present disclosure relates to a cleaner attachment device, in particular a device for attachment to a vacuum or pressure cleaner. More particularly, but not exclusively, the disclosure relates to an attachment for cleaning behind water heaters or in other narrow spaces.

BACKGROUND

Increasing awareness of cleanliness, hygiene and allergens in many societies leads many users to seek higher levels of maintenance of their environment.

Many users may use vacuum cleaners or pressure cleaners to clean their homes or business premises.

Vacuum cleaners in particular come with a variety of attachments arranged for accessing a variety of different areas in a typical environment.

For example long attachments for vacuuming in narrow spaces are common in the art. However, distancing the point of suction further away from the vacuum cleaner does not particularly aid in cleaning the sides of the narrow space.

Accordingly a number of patent applications have been filed in an attempt to resolve the problem.

U.S. Pat. No. 8,083,860 (LOFTIS) discloses a cleaning system for dusting and cleaning a room.

German patent application DE 20 313 244 (GOLDIN et al) discloses a vacuum cleaner tool is an elastic, flexible pipe for connection at one end to a conventional vacuum cleaner and with its opposite end designed to suck dust from narrow spaces. The pipe has several openings along its length that represent the suction surface. The outer surface of the pipe is fitted with elastic, flexible brushes.

Korean patent application KR 100 507 924 (PARK et al) discloses an auxiliary cleaning tool of a vacuum cleaner, comprising: a stationary body, formed as a hollow cylinder, which is removably connected to an end of a suction hose assembly connected to a cleaner body. The stationary body has a plurality of suction holes formed therealong.

SUMMARY

According to the disclosure, there is provided a cleaner attachment device comprising an elongate body with a plurality of apertures arranged helically along the body, and a plurality resiliently deformable portions arranged along the body and extending from the body.

According to an aspect of the present disclosure there is provided a cleaner attachment device, comprising: an elongate body with a plurality of longitudinally arranged apertures and a plurality of longitudinally arranged resiliently deformable portions extending from the body.

Said cleaner may comprise a vacuum cleaner, or may in some embodiments comprise a pressure cleaner or other cleaner expelling fluid, rather than operating through suction.

In some embodiments the apertures are through the exterior surface or surfaces between the two opposite ends of the elongate body. In some embodiments the deformable portions are arranged longitudinally on the exterior surface or surfaces between the two opposite ends of the elongate body.

In some embodiments the resiliently deformable portions comprise padding or cellular structure material such as foam.

In some embodiments the portions comprise individual members such as bristles. For example the portions may comprise brushes, which brushes are arranged longitudinally on the body, with bristles extending orthogonally from the body. In this way the bristles may be arranged to be flexible individually as well as a whole brush, so that they may be used to dislodge small particles, as well as to sweep an area.

In some embodiments the apertures are extended to the length of the body or portions. In other embodiments the apertures may comprise a plurality of apertures arranged along the body to approximate the length of the portions. For example, the apertures may be elongate slits which extend along the length of the body, or may comprise a plurality of apertures arranged along a longitudinal axis along the exterior surface of the body, or may comprise a plurality of apertures arranged helically (helixically) around the radial axis along the exterior surface of the body. The apertures may be arranged to form a double helix along the exterior surface of the body. The apertures may be evenly spaced, such that the spacing between adjacent apertures along the longitudinal axis or helix is substantially equal. Alternatively, the spacing between adjacent apertures along the longitudinal axis or helix may differ. For example, the apertures may be more closely spaced towards a first end of the body, and may be more sparsely spaced towards a second opposing end of the body. Where the apertures comprise a plurality of apertures, the apertures may be of any shape. For example, each aperture may be substantially circular or square-shaped, or each aperture may be elongate, for example oval-shaped or rectangular. A longitudinal axis of each aperture may be aligned with the longitudinal axis or helix along which the apertures are arranged. Alternatively, a longitudinal axis of each aperture may be positioned obliquely with respect to the longitudinal axis or helix along which the apertures are arranged. For example, in the case of a plurality of rectangular apertures arranged helically along the exterior surface of the body, a longitudinal axis of each rectangular aperture may be aligned with a longitudinal axis of the body.

In some embodiments the apertures are arranged intermediate the deformable portions, such that any dust dislodged by the portions will be sequentially or subsequently sucked through the apertures. In some embodiments the apertures may be of equivalent length to the deformable portions and may be interspersed between the deformable portions in order to form a discrete arrangement of portions and apertures. In some embodiments the apertures may be arranged within the portions. In some embodiments the apertures may be covered by the deformable portions, in such embodiments the deformable portions may be permeable to dust or other debris below a certain size. The portions may comprise plural bristles, for example of horsehair, plastics or other materials liable to be used in similar brush applications.

The interior of the elongate body may be hollow so as to facilitate the passage of dust or debris which enters the body through the apertures along the length of the attachment means and into an external vacuum device. The interior of the elongate body may contain a smooth walled passageway through which dust or debris passes, so as to reduce the risk of objects becoming stuck inside the device, blocking it and thereby reducing the vacuum force.

In some embodiments the apertures are elongate slits parallel to the length of the body with two walls which extend into the body radially. The internal walls may narrow the slit internally to a central elongate opening to the internal volume of the body.

In some embodiments the body comprises at least one discrete opening, such that the device may be used for detail vacuuming. Such opening may be wider than the apertures, and/or more focussed or smaller, so as to allow greater control.

Such opening may be situated at, adjacent or on the end of the device which is distal from the vacuum cleaner in use.

In some embodiments the apertures may vary in width or shaping, for example along the length of the body. In this way the apertures may allow for variation in vacuum strength through the body, for example so as to enable uniform or controlled sucking. For example, in some embodiments the apertures may widen towards the end distal from the vacuum cleaner so as to compensate for the reduced vacuum force. Alternatively, the shape or width of the apertures may be varied so as to produce different sucking strengths at different points on the exterior surface of the body.

In some embodiments the apertures may be serrated, perforations, or sinuous.

The apertures may also be envisaged to continue past the brushes and/or past where the body is reduced in sectional diameter, the perforation of the vacuum attachment may continue such that dislodged matter is drawn into the vacuum cleaner hose better from air surrounding the portions.

In some embodiments the device comprises longitudinal apertures and resiliently deformable portions on matching sides, for example providing a substantially triangular or other geometrically shaped multi-face sectional body profile, for example with extending portions from each face. In this way the body provides a strong compact form both usable in a plurality of orientations and able to be pressed against a long flat surface if necessary.

In some embodiments the device comprises a vacuum attachment means. Such attachment means may comprise friction fitting, comprising a hose attachment means. This may facilitate the attachment of the vacuum attachment means to a conventional vacuum cleaner.

In some embodiments the vacuum attachment means may include a wider diameter than the body. The attachment means may comprise a standard vacuum cleaner attachment fitting, such as a friction fitting. This may allow the vacuum attachment means to be narrower than the hose of a conventional vacuum cleaner, thereby increasing the suction force through the apertures.

In some embodiments the device comprises a flexible portion, which may comprise a hose or may comprise an articulated joint. In such way the device may comprise an elongate rigid body and flexible hose which can be adjoined, for example wherein multiple flexible portions are connected to facilitate the device or cleaner use. The flexible portion may allow the user to manoeuvre the body into position, for example behind a radiator.

Some embodiments may include more than one flexible portion.

In some embodiments the body may be a rigid straight elongate tubular body so as to facilitate the manipulation and control of the device. In other embodiments the body may be a flexible hose with longitudinal apertures extending along the exterior of the length of the hose, thereby allowing the attachment to clean a variety of differently shaped areas or cavities.

In some embodiments the apertures may comprise shaping to encourage air into the body, for example funnelling or chamfered shoulders.

In some embodiments the resiliently deformable portions may be displaceable or may be replaceable, for example, wholly or slidably. For example the device may comprise anchors or slots therefor.

In some embodiments the apertures may comprise filter means. For example, in some embodiments filters may be displaceable or may be replaceable, for example wholly or slidably.

DESCRIPTION

DETAILED DESCRIPTION OF FIGURES

Figure 1A:
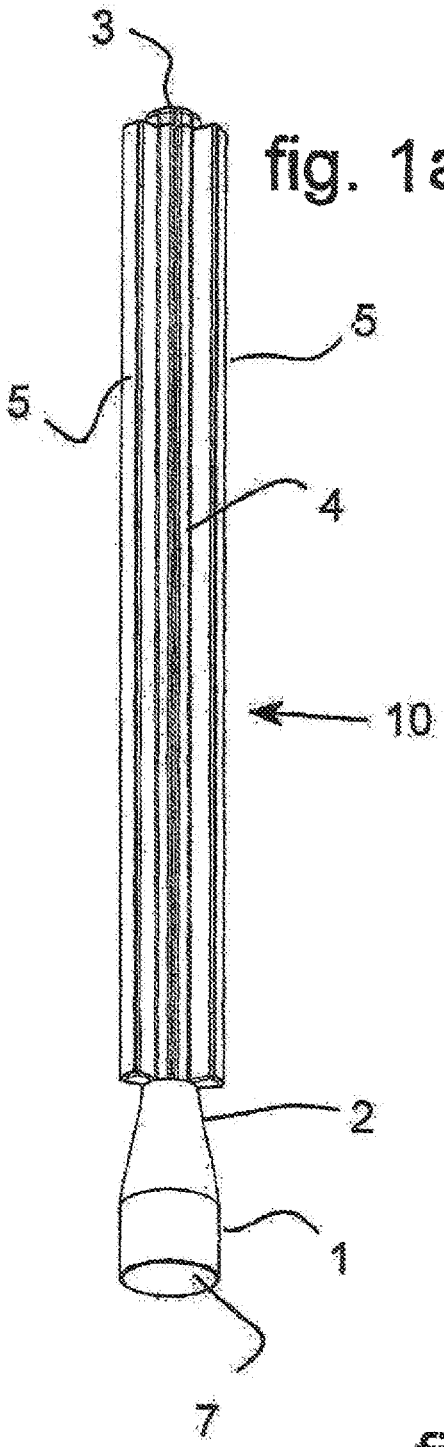
FIG. 1 show isometric views of a first embodiment of the device according to the present disclosure.
Figure 1B:
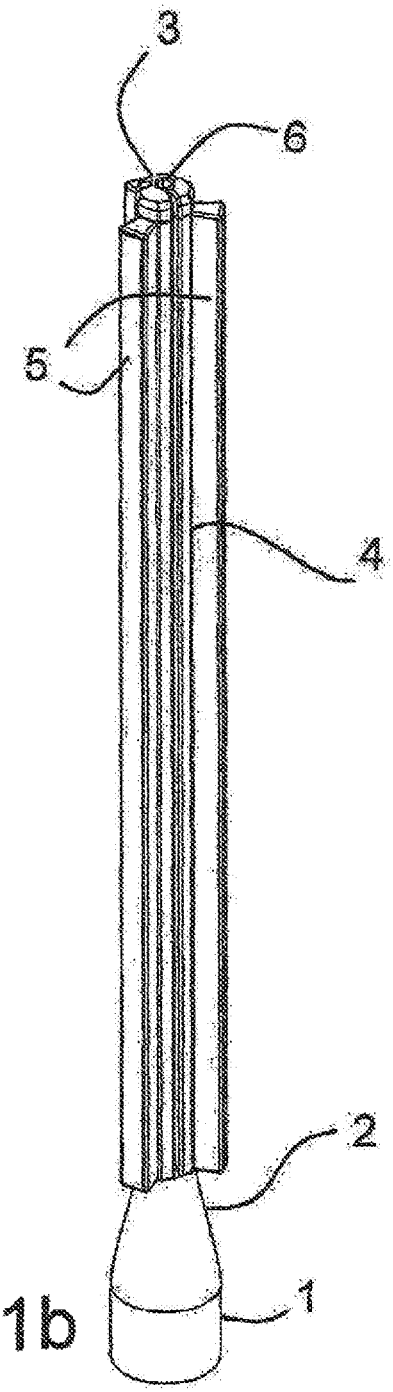
Figures 2A, 2B:
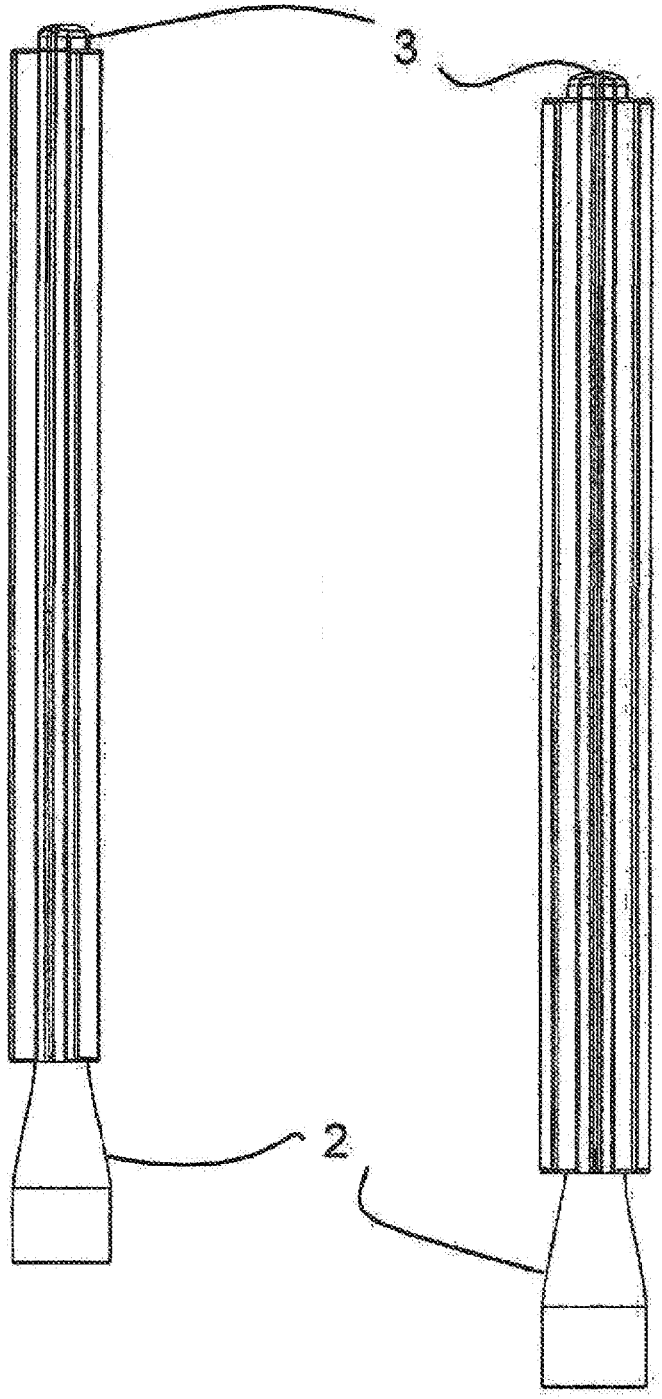
FIG. 2 show two side views of the embodiment shown in FIG. 1.
Figure 3:
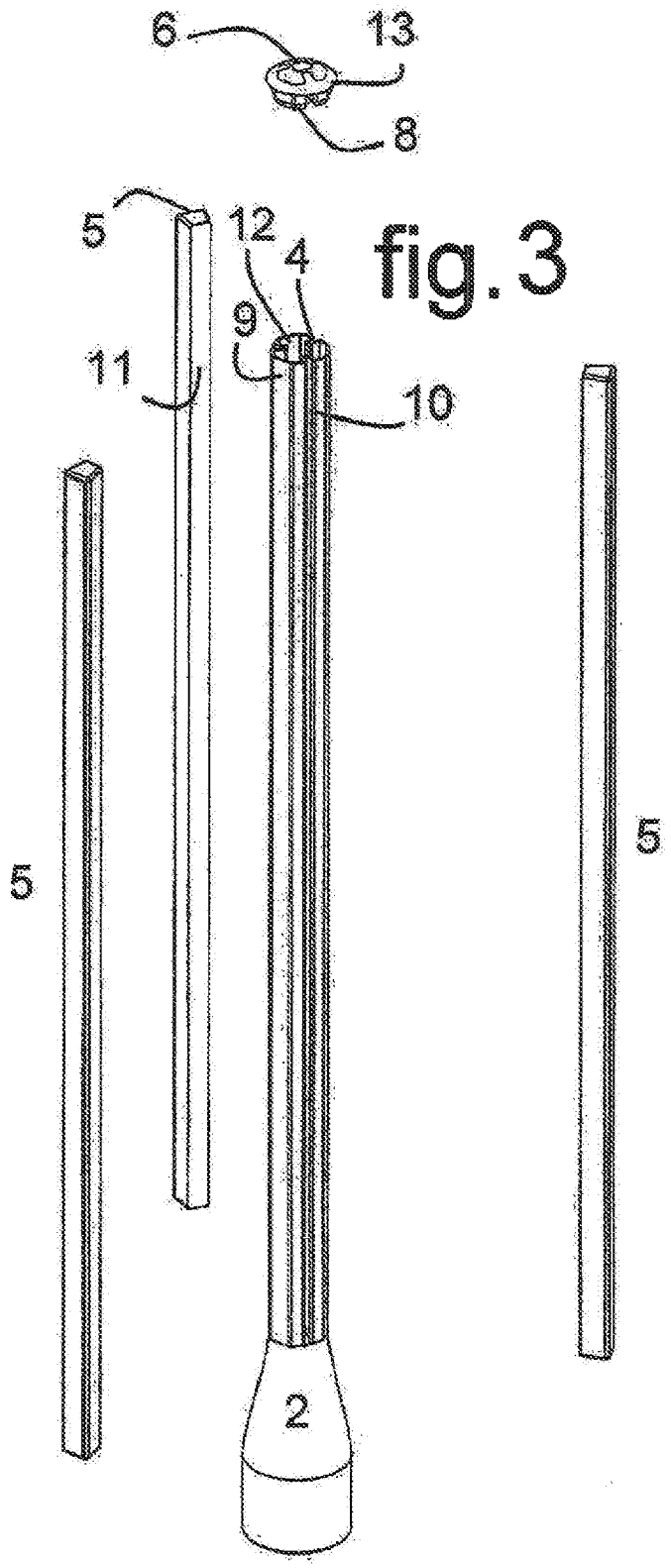
FIG. 3 shows an isometric exploded view of a second embodiment of the device according to the present disclosure.
Figure 4:
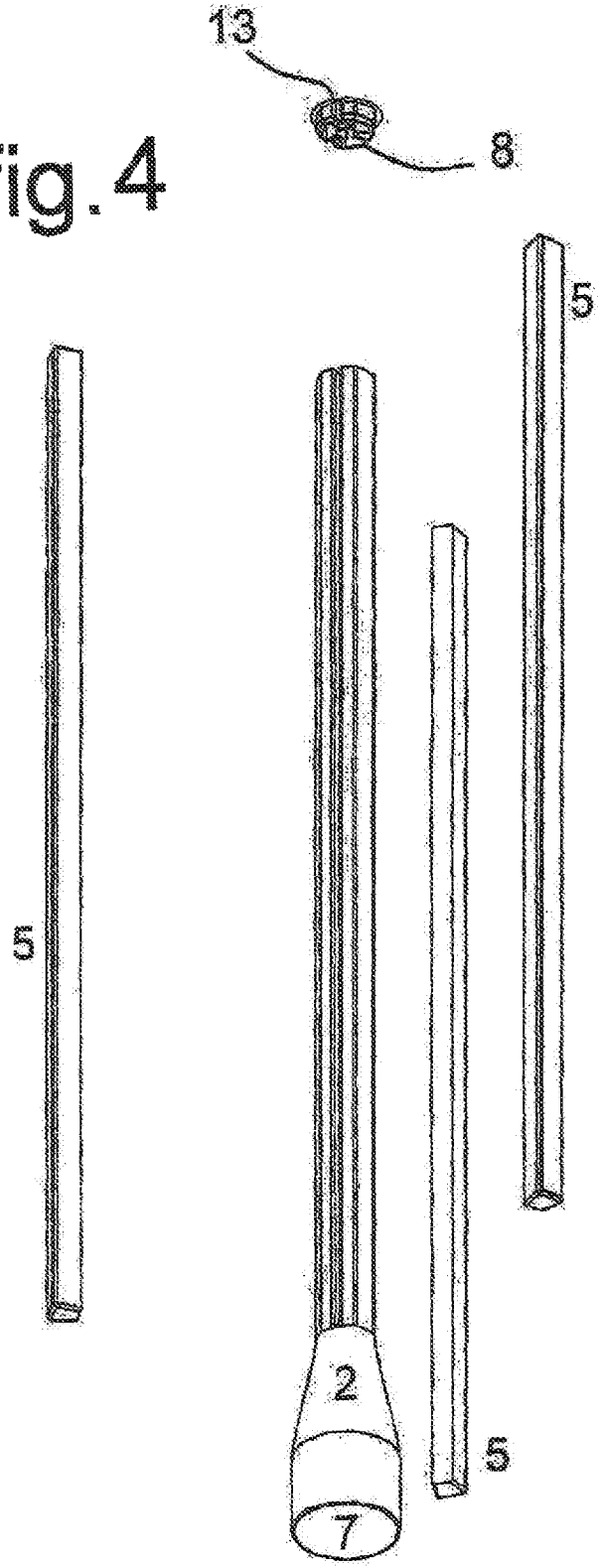
FIG. 4 show a reverse exploded isometric view of the embodiment shown in FIG. 3.

With reference to the figures there is shown a number of embodiments of the vacuum attachment means comprising a hose fitting end with a collar 1 describing an opening 7 arranged to friction fit a vacuum cleaner hose (not shown).

The opening diameter decreases in a Venturi cone 2 to an elongate body 10.

Three longitudinal apertures 4 pass through the exterior wall of the elongate body 10 and three longitudinal brush portions 5 are arranged on the exterior of the elongate body 10. The apertures 4 and brush portions 5 extend along the length of the body 10 between the distal end 3 of the body 10 and the venture cone 2 of the hose fitting end. The apertures 4 and brush portions 5 alternate around the substantially triangular circumference of the cross section of the body 10, such that an aperture 4 is between each two brushes 5 and a brush 5 is between each two apertures 4.

The elongate body is in the shape of an elongate triangular prism.

In some embodiments the device may be used with air suction or with water pressure, so as to remove matter from confined areas. In this way the device may be used to clean inside piping and tubing.

One specific application is as an attachment for domestic or industrial cleaner enabling the efficient removal of dirt or dust particles from spaces which are not reachable using existing vacuum cleaner attachments, for example, corrugated flutings, or behind, or under fixed objects with limited or narrow accessibility.

In use the device may be manipulated into small spaces and the brush portions may be gently or vigorously passed over surfaces to be cleaned so as to dislodge debris or dust particles, with suction removing the dislodged particles.

The body is formed from thermoplastics, metals or alloys, and the resiliently deformable brush portions comprise a plurality of plastic, or other materials, bristles.

The apertures comprise a chamfered opening 10, and are formed as single elongate apertures, defined by two internally radially extending sides narrowing internally to leave an open central elongate internal volume 12.

The brushes comprise splaying bristles and a backing plate 11, adhered in use to a planar base 9 on the body.

The device is arranged to be attached to the vacuum cleaner hosing by friction fitting, being slid onto the hose.

In variant embodiments the dimensions of bristle length, diameter and length of the device may be varied.

The vacuum cleaner attachments will be used predominantly for the removal of dust from hard-to-reach areas like between walls and the backs of radiators or behind, beneath, above and within radiators and other structures.

The device may be envisaged as part of an existing vacuum cleaner or as a retrofit and standalone aftermarket item, for example in some embodiments suited to users with bronchial or asthmatic conditions.

After the dust is disturbed, agitated or dislodged it will be sucked through the three suction apertures positioned along the side of the body. In addition to this there is a triangular opening at the end of the tube to remove any remaining dust.

The device may be approximately 10 cm to 60 cm long.

In the first embodiment the body comprises an end cap 3, distal from the attachment means and arranged with a central opening 6 for detail vacuuming.

The end cap comprises a domed top and extending sides such that the end reaches beyond the brush portions, and may be placed on or against a flat surface from a plurality of angles.

In the second embodiment the end cap comprises a generally domed disc 13, supported by sides 8 that are inserted into the body in use, such that the portions extend to substantially reach to the end of the device in use. This may allow the device to more easily clean surfaces adjacent to obstacles or end walls.

Figure 5A:
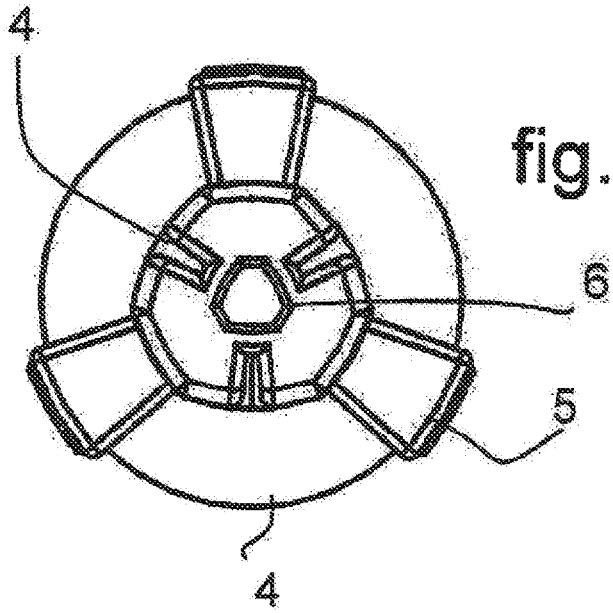
FIG. 5 show end views of the embodiment shown in FIG. 1.
Figure 5B:
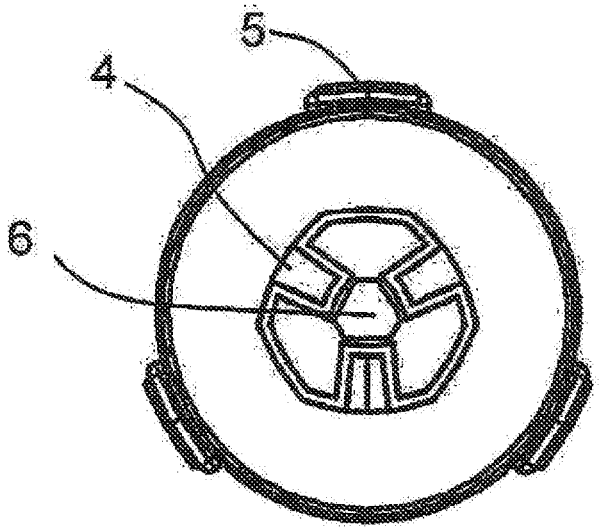

The aperture through the cap in the first embodiment can be seen in FIGS. 5*a* and 5*b*, the aperture 6 through then centre of the body continues through the cap, so as to allow use thereof in detail vacuuming.

Figure 7A:
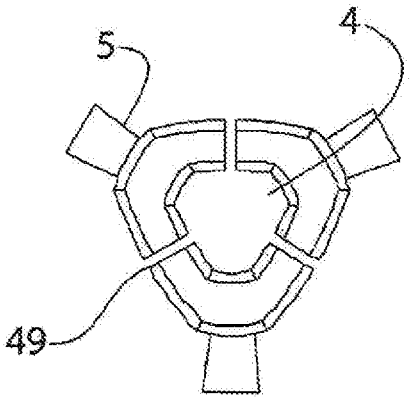
FIG. 7 show sketches of detail views of further embodiments of the device according to the present disclosure.

In the embodiment shown in FIG. 7*a* the hexagonal opening 4 to the body reflects the substantially triangular cross section of the body, and the longitudinal apertures are continuous to the end such that they intersect the end opening through the cap, the body may comprise internal bracing to support the shape of the body without the end cap. Additional brush portions surround the end opening between the longitudinal apertures so as to facilitate the dislodging of dust during detail vacuuming.

Figure 7B:
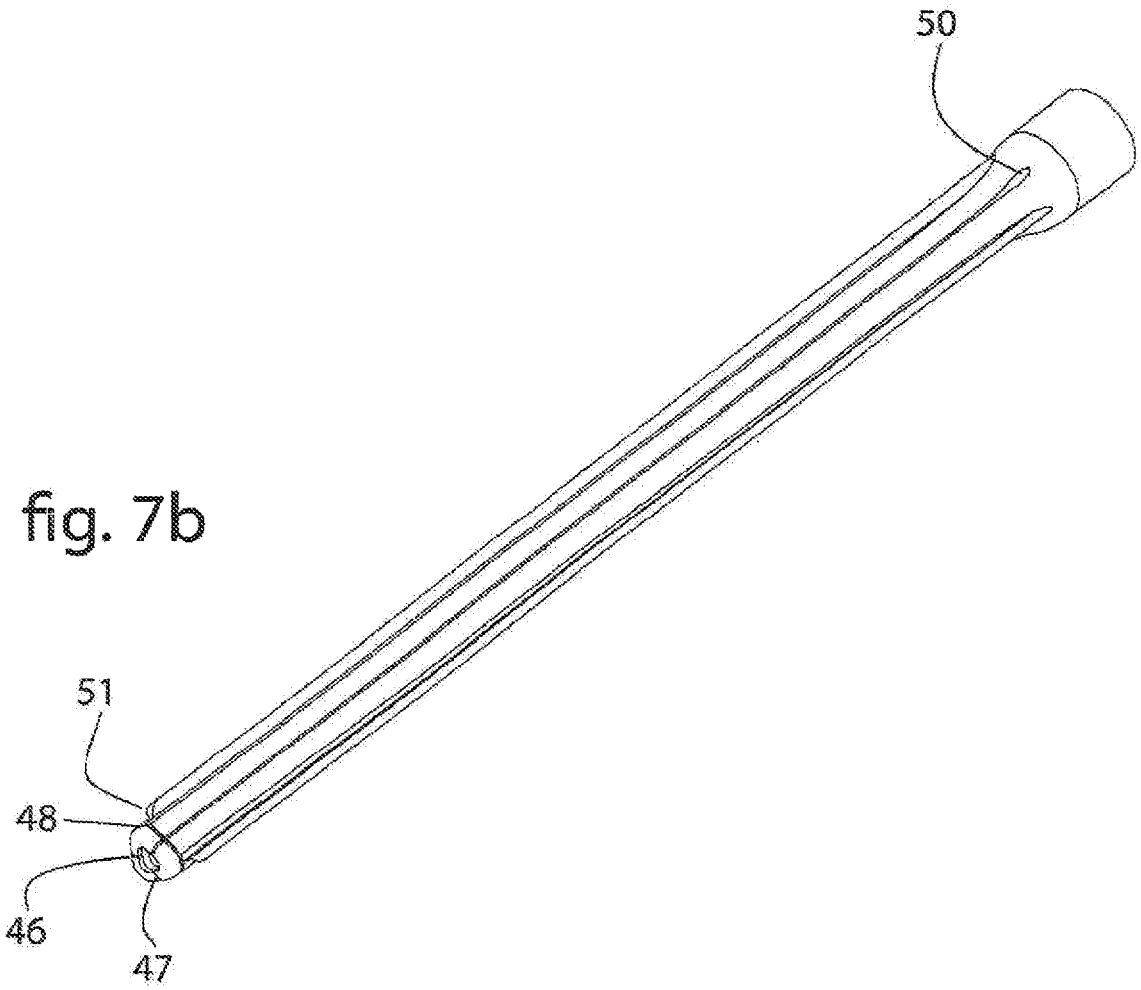

In the embodiment shown in FIG. 7*b* the end cap comprises a triangular opening 46 and the end further comprises a lateral opening 48 and openings 47 arranged to traverse the end from side to side. In this way the user is afforded more variability in detail vacuuming.

The brush portions 51 are inclined away from the end cap so as to permit easier manoeuvrability in narrow spaces.

The apertures 50 flare towards the vacuum cleaner and extend up the cone so as to aid in generalised sucking after the dust has been dislodged by the portions.

Figure 7C:
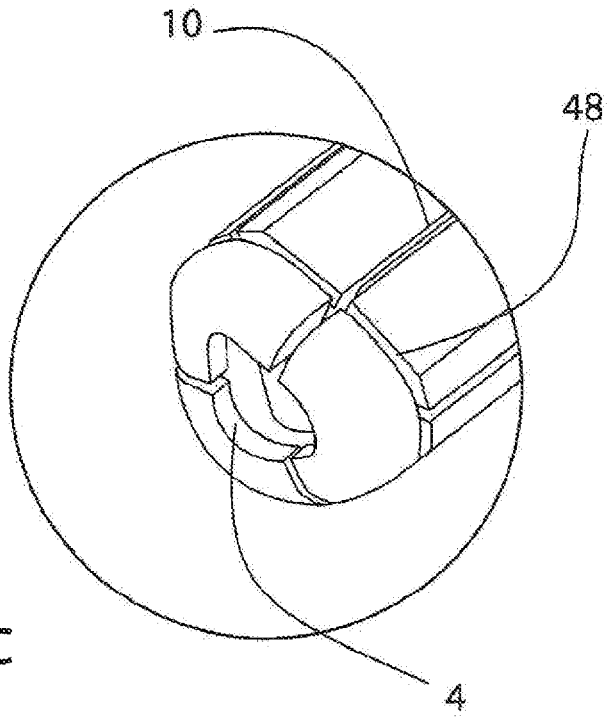

In the embodiment shown in FIG. 7*c* the end cap comprise a lateral opening 48 around the circumference of the end's cross section only, and no apertures. The end cap may be permanently secured to the body and spaced apart therefrom so as to allow entrance of air at the lateral opening(s).

Figure 6:
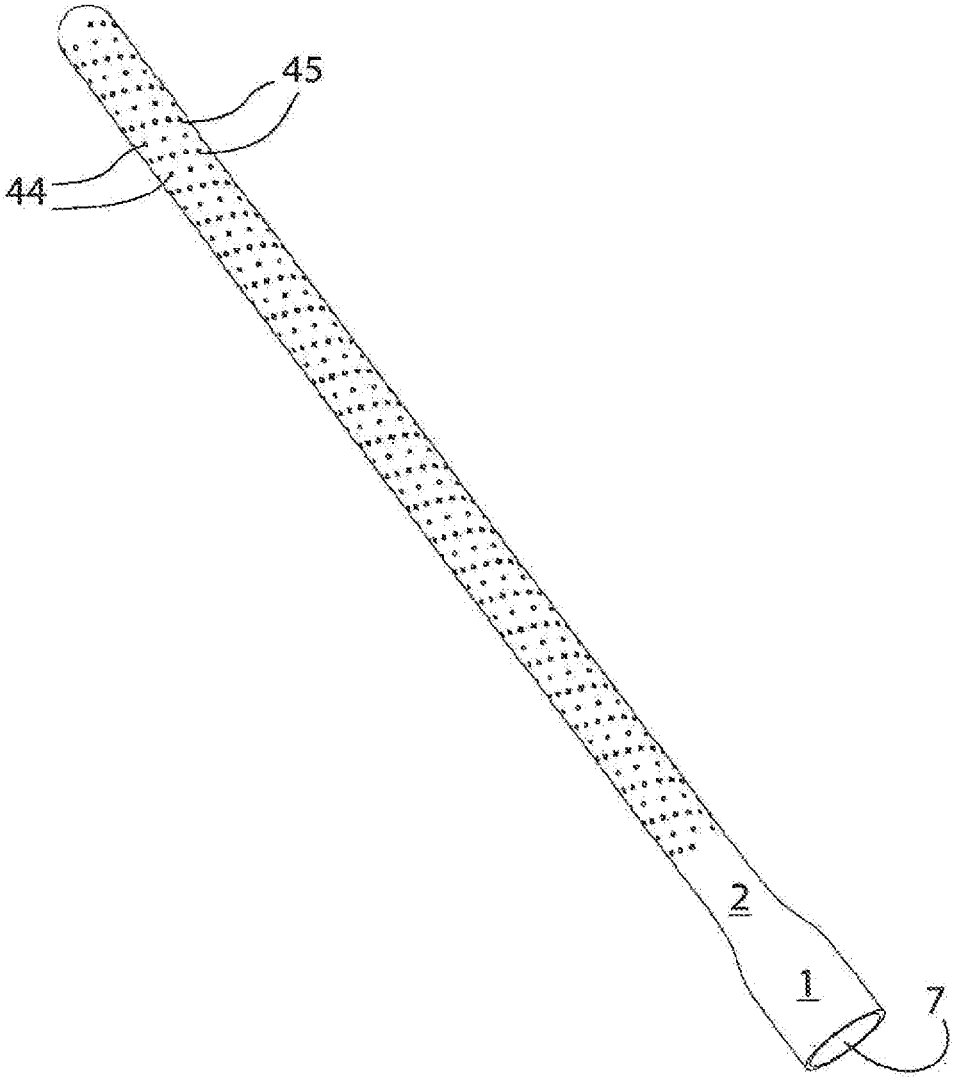
FIG. 6 shows an isometric view of a third embodiment of the device according to the present disclosure.

In the embodiment shown in FIG. 6 the apertures 44 and bristle portions 45 are provided adjacent one another and are distributed over the elongate surface of the body.

Figure 8:
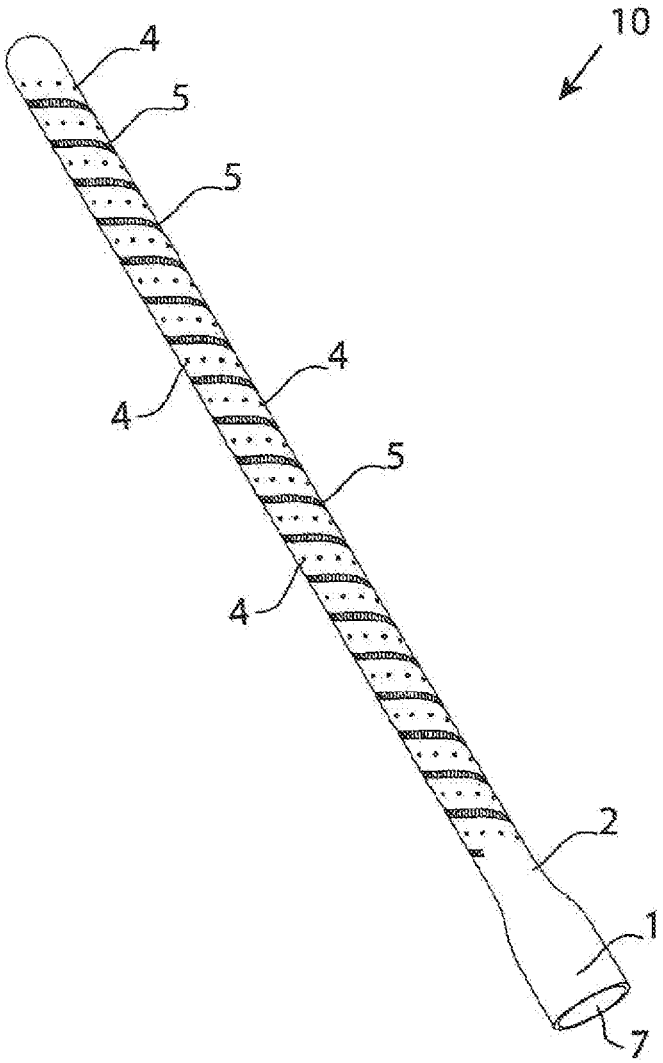
FIGS. 8 to 10 show isometric views of fourth, fifth, and sixth embodiments of a device according to the present disclosure.
Figure 9:
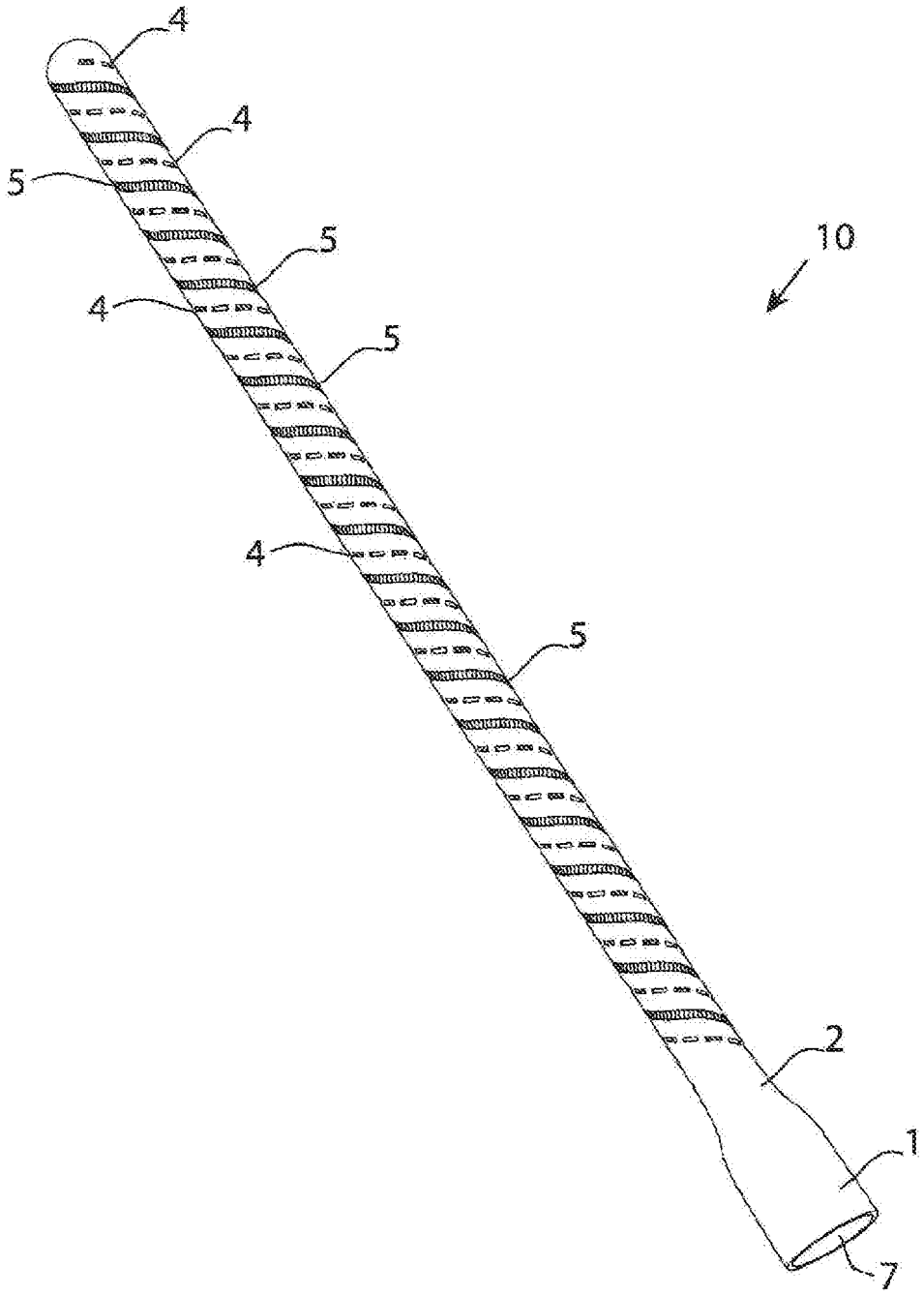
Figure 10:
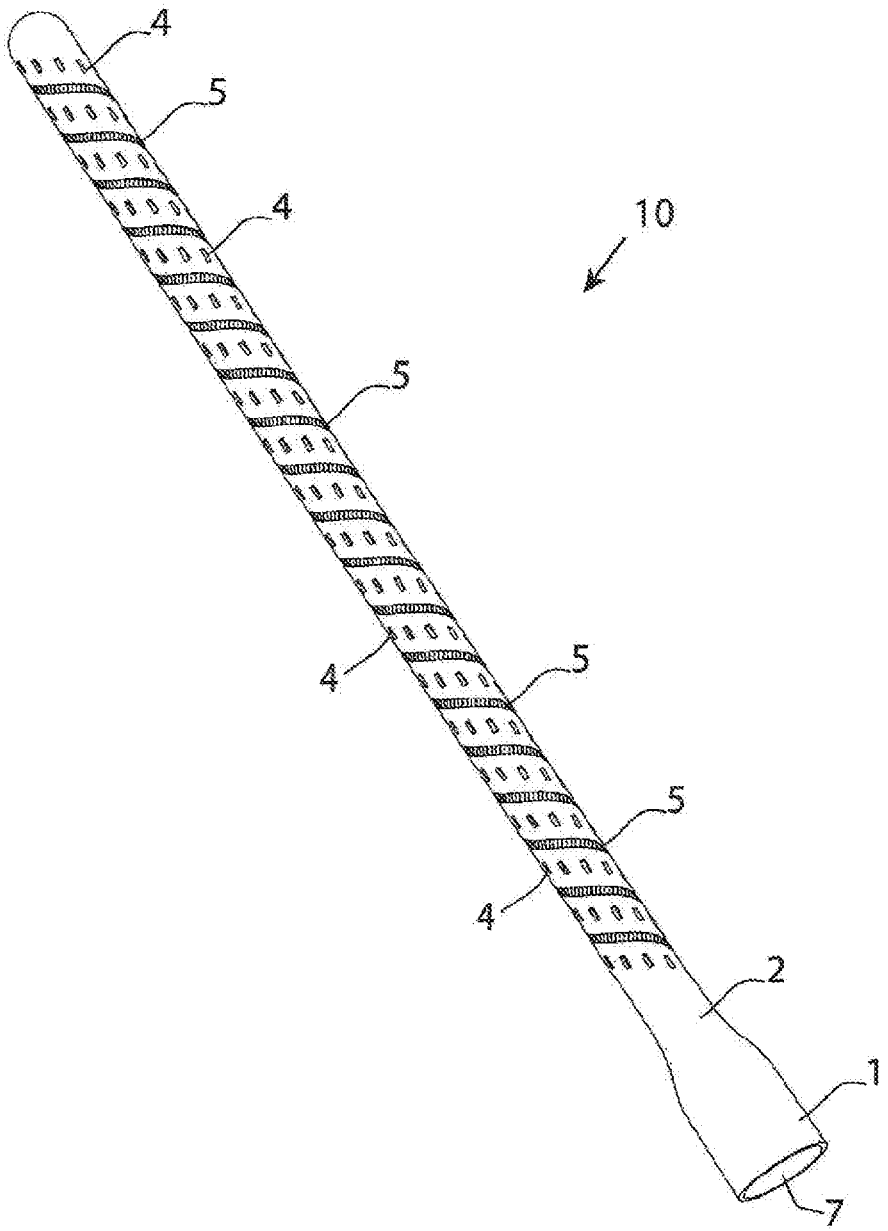

In FIGS. 8 to 10, the apertures 4 are arranged helically along an exterior surface of the elongate body 10. Resiliently deformable portions 5 are also arranged helically along an exterior surface of the elongate body 10. In FIG. 8, the apertures 4 are circular and are arranged along the helix. In FIGS. 9 and 10, the apertures are rectangular, and are therefore elongate. In FIG. 9, a longitudinal axis of each rectangular aperture 4 is aligned with the helix. In FIG. 10, a longitudinal axis of each rectangular aperture 4 is aligned with a longitudinal axis of the elongate body 10.

The device is compatible with existing vacuum hoses for a secure fit.

The apertures help channel airflow and dust into the device and down the vacuum hose.

As described above, the device comprises apertures arranged along the length of the body (for example, helically), and optionally an opening in the tip of the body at a distal end (the distal end being opposite to the proximal end where the body may have attachment means for attachment to a cleaning device or be permanently attached to the cleaning device). It is preferred that the opening has a variable aperture (the aperture may even be closeable). The opening and apertures are in communication. In this way, a balance of fluid flow from/to a cleaning device between the opening and the apertures may be adjustable by the user. Such a variable aperture may be provided in a variety of forms, for example, the opening may have inserted therein a bung in the form of a cone or pyramid (with its point inserted into the opening) that may be drawn into the body in the longitudinal direction to reduce the flow area through the opening or translated longitudinally out of the body to increase the flow area through the opening. Such adjustment may be made at the proximal end of the body, by rotation of a threaded rod on which the bung is mounted.

Alternatively, an adjustable baffle plate may cooperate with a second baffle plate covering the opening of the tip of the body. The adjustable baffle plate may have a plurality of holes therethrough that can align with corresponding holes in the second baffle plate. Rotation of the adjustable baffle plate varies the alignment of the holes of the two baffle plates to thereby control their effective opening degree. Again, the adjustment can be effected from the proximal end of the body. In this way, the device can be used to clean surfaces parallel to the length of the body, or surfaces perpendicular to the tip of the body, or both with a controlled flow for either flow path.

The invention has been described by way of examples only and it will be appreciated that variation may be made to the above-mentioned embodiments without departing from the scope of disclosure as defined by the claims, in particular but not solely combination of features of described embodiments.

The invention claimed is:

1. A cleaner attachment device, comprising: an elongate body with a plurality of apertures arranged in a first helical pattern along the body, and a plurality of resiliently deformable portions arranged in a second helical pattern that is substantially parallel to the first helical pattern along the body and extending from the body.

2. The device of claim 1, wherein the plurality of resiliently deformable portions are arranged helically along the body and extend from the body.

3. The device according to claim 1, wherein the device comprises a cleaner attachment means at a first end.

4. The device according to claim 3, wherein the body is narrower in diameter than the cleaner attachment means.

5. The device according to claim 1, wherein the plurality of resiliently deformable portions comprises a plurality of bristles.

6. The device according to claim 1, wherein the plurality of apertures includes three apertures and the plurality of resiliently deformable portions includes three resiliently deformable portions.

7. The device according to claim 1, wherein the plurality of apertures comprises rectangular apertures.

8. The device according to claim 1, wherein the plurality of resiliently deformable portions are elongated and substantially extend the length of the body.

9. The device according to claim 1, wherein the plurality of resiliently deformable portions are displaceable.

10. The device according to claim 1 for use with a vacuum cleaner.

11. The device according to claim 1 for use with a pressure cleaner.

12. The device according to claim 1, wherein the plurality of apertures vary in width or shaping.

13. The device according to claim 1, wherein the plurality of resiliently deformable portions comprise padding.

14. The device according to claim 1, wherein the plurality of resiliently deformable portions comprises a cellular structure material.

15. The device according to claim 1, wherein the plurality of apertures are covered by the plurality of resiliently deformable portions.

16. The device according to claim 15, wherein the plurality of resiliently deformable portions are permeable to dust or other debris below a certain size.

17. The device according to claim 1, wherein the plurality of apertures comprises elongate slits with two walls which extend radially into the body.

18. The device according to claim 1, further comprising a substantially triangular or other geometrically shaped multiface sectional body profile.

19. The device according to claim 1, wherein the plurality of apertures comprise shaping to encourage air into the body.

20. The device of claim 1, further comprising an opening at the distal end of the elongate body.

21. The device of claim 20, wherein the opening has a variable aperture.

* * * * *